US005115927A

United States Patent [19]

Wallace et al.

[11] Patent Number: 5,115,927

[45] Date of Patent: May 26, 1992

[54] STRENGTHENING MECHANISM FOR A FEMALE ARTICULATED COUPLING MEMBER FOR PROVIDING ADDITIONAL STRENGTH IN RESPONSE TO LOADS EXERTED AT BEARING ASSEMBLY CONNECTION SHAFT

[75] Inventors: William D. Wallace, Chicago, Ill.; Edward G. Lynch, Jr., Saugus, Calif.; David W. Daugherty, Jr., Bolingbrook; Wajih Kanjo, Lockport, both of Ill.; Michael G. Hawryszkow, Munster, Ind.

[73] Assignee: Westinghouse Air Brake Company, Wilmerding, Pa.

[21] Appl. No.: 586,511

[22] Filed: Sep. 21, 1990

[51] Int. Cl.[5] ..... B61G 5/02

[52] U.S. Cl. ..... 213/75 R; 105/3; 403/113

[58] Field of Search ..... 105/3, 4.1, 4.2; 213/12, 14, 74, 75 R, 62 R, 50, 98, 188; 280/511; 180/134; 403/113, 117, 119

[56] References Cited

U.S. PATENT DOCUMENTS

| | | | |
|---|---|---|---|
| 1,978,859 | 10/1934 | Draeger | 213/74 |
| 2,013,546 | 9/1935 | Wallace | 105/3 |
| 2,334,034 | 11/1943 | Richards | 213/188 |
| 3,399,631 | 9/1968 | Weber | 105/4.1 |
| 3,476,040 | 11/1969 | Karakashian et al. | 105/200 X |
| 3,687,084 | 8/1972 | O'Leary et al. | 105/4.1 |
| 3,721,482 | 3/1973 | Tack et al. | 105/4.1 |
| 4,258,628 | 3/1981 | Altherr | 105/4 R |
| 4,336,758 | 6/1982 | Radwill | 105/4.1 |
| 4,593,829 | 6/1986 | Altherr | 213/75 R |
| 4,867,071 | 9/1989 | Weber | 105/4.1 |

OTHER PUBLICATIONS

Maintenance Manual for ASF Articulated Connection Assembly.

*Primary Examiner*—Robert J. Oberleitner
*Assistant Examiner*—S. Joseph Morano
*Attorney, Agent, or Firm*—G. J. Falce

[57] ABSTRACT

The present invention provides a strengthening mechanism for a female connection member used in a articulated coupling arrangement. Such female connection members include a first end portion configured for connection to one end of a railway car center sill member and a second end portion formed integrally with such first end portion. A cavity is formed in such second end portion and is defined by a bottom wall portion, a rear wall portion and a pair of side wall portions. Such cavity being open adjacent the front and top surface thereof. An opening is formed through a portion of each of such side wall portions. Each such opening includes a slot-like portion and a generally arcuate portion spaced below such slot-like portion. At least one strengthening mechanism is formed integrally with at least one of such pair of side wall portions adjacent such second end portion and is disposed adjacent such slot-like portion adjacent such top surface of such at least one of such pair of side wall portions to provide the requisite amount of force absorbing capability to such female connection member during service in a train consist.

26 Claims, 3 Drawing Sheets

STRENGTHENING MECHANISM FOR A FEMALE ARTICULATED COUPLING MEMBER FOR PROVIDING ADDITIONAL STRENGTH IN RESPONSE TO LOADS EXERTED AT BEARING ASSEMBLY CONNECTION SHAFT

FIELD OF THE INVENTION

The present invention relates, in general, to coupling devices used to connect adjacent ends of a pair of railway cars and more particularly, this invention relates to a mechanism to strengthen the female connection member in a top loading articulated coupling arrangement used to connect one end of a first railway car to an adjacent end of a second railway car, in a substantially semi-permanent manner, and which with the use of a single truck disposed beneath such coupling arrangement enables all standard size railway cars presently in use by the railway industry to negotiate all known curves encountered in present track structures.

BACKGROUND OF THE INVENTION

In the railroad industry, couplers are used to connect adjacent ends of a pair of railway cars together. On those railway cars which will be used in interchange service, such couplers must be approved by the Association of American Railroads (AAR) prior to installation on such cars. It is well known, in this application, that such couplers serve a number of functions in addition to facilitating the connection and disconnection of individual cars to and from, respectively, a train consist. One function, for example, is to enable such individual cars to negotiate curved portions of the track structure. Further, the couplers enable such cars to be readily combined to make up such train consist, or to be readily separated individually for either loading or unloading cargo thereto or therefrom respectively. This permits a railroad to leave a particular car at a customer's plant while delivering or picking up other cargo at other locations.

In more recent times, however, the railroad industry has come to recognize that a number of rather important advantages can be gained by interconnecting several railway cars to form a generally semi-permanent unit. For example, this is particularly the case, where such individual railway cars are adapted for use in "piggyback" service. A primary reason for this is that the cargo to be either loaded or unloaded is brought to or removed from, respectively, central locations. Generally, this cargo is either over-the-road trailers or large containers. The individual railroad cars which have been joined together in this generally semi-permanent manner are commonly known in such railroad industry as a "10-pack". Except at each outer end of each 10-pack unit, these 10-pack units do not require the use of standard couplers. The primary reason why such standard couplers are not required is because of their dedicated service these 10-pack units are only broken periodically. Normally, for example, this will only occur when maintenance must be carried out on an individual coupler component or other component on the railway car that requires such car to be taken out of service temporarily. It is obvious to the railroad industry that is possible to achieve a considerable cost reduction by this coupling arrangement. Such cost-savings are derived from a variety of reasons. Such reasons include: lower equipment weight, resulting in enhanced energy savings and fewer railway trucks which results in both lower equipment cost and a reduction in maintenance requirements. However, with the now rather extensive use of these semi-permanent coupling arrangements, particularly with new cars being built for piggyback service, and with ever increasing loads being carried by modern railway cars and train consists, it has been determined that it is of the utmost importance for a close-buttoned relationship to be maintained between the coupler draft components. Such close-buttoned relationship is required, for example, so that the effects of the impact forces which are usually encountered under normal buff conditions during train operation can be reduced to an acceptable level. In this manner, damage to both cargo and equipment can be held to a minimum.

One prior art type of articulated coupling apparatus used for the purpose of connecting adjacent ends of a pair of railway cars together in a semi-permanent manner is taught in U.S. Pat. No. 4,258,628. As shown therein, this particular articulated coupling device includes a male connection member secured to one end of a first railway car body and a female connection member which is secured to an adjacent end of a second railway car body. The female connection member, in this prior art arrangement, is rotatably-engaged in a center plate bowl portion of the bolster of a railway car truck. Such rotatable engagement is carried out in a manner that is well known in the railway art. The outer end portion of the male connection member is disposed for movement within a cavity formed in the outer end portion of such female connection member. A pin member is utilized to join both the male connection member and the female connection member together in such semi-permanent fashion. This pin member is positioned in a vertical direction and is disposed in aligned apertures which are formed in each of such male connection member and such female connection member. As taught in this reference, the aperture formed in the male connection member for receiving the pin member therein must be somewhat larger than the pin member itself. This is required so that certain required movements of the coupling arrangement while in operation can be achieved. Additionally, a rear surface portion of the aperture that is formed in such male connection member, which will receive the pin member therein, has a horizontal concave configuration and a vertical convex configuration. This particular configuration will enable both the male connection member and the female connection member to move in each of a horizontal direction and a vertical direction in relationship to one another while, at the same time, this configuration provides a relatively substantial area of surface contact between the rear surface of such pin aperture and the pin member itself. The outer end surface of the outer end portion of such male connection member includes a convex configuration which abutingly engages a complimentary concave surface which is formed on a front face portion of a follower member. In this coupling device, such follower member is carried within the rear portion of such cavity disposed in the outer end portion of such female connection member. A pair of vertically-disposed, slot-like cavities are formed on such follower member adjacent the rear surface portion thereof. Disposed within each of these vertical slot-like cavities is a first portion of a resilient member. A second portion of such resilient member extends outwardly from such rear face portion of the follower member. In this manner, a portion of the exposed outer surface of each such resilient member can be engaged by a vertically disposed wedge-like element. Such wedge-like element being required in this coupling arrangement to urge the follower member and the male connection member forward. As a result, the rear surface portion of the aperture formed in the outer end of the male connection member is maintained substantially in contact with the pin member at all times.

Such contact between the pin member and the rear surface portion of this aperture in the male connection member is required in this coupling arrangement because most of the articulated connecting members used are manufactured as cast components. Furthermore, in order to achieve a reduction in the cost of this coupling device, such cast components receive very little, if any, finish-machining to provide the necessary or desirable dimensional control. In other words, these cast components are generally used as cast. As a result of this cost-saving practice, it is oftentimes difficult to provide an articulated coupling device which will be self-adjusting under the various wear conditions encountered by such coupling device during in track operation. However, it is important to minimize the slack encountered in the various coupling connections during such in track service.

Other prior art coupling devices are taught in U.S. Pat. No. 3,716,146 and Canadian Patent Number 1,231,078.

SUMMARY OF THE INVENTION

The present invention provides a female connection member, having a strengthening mechanism, for use in an articulated coupling apparatus in which a bearing assembly is loaded into at least one cavity formed in such female articulated coupling member adjacent a top surface thereof. Such female connection member includes a first end portion which has a predetermined configuration. Such predetermined configuration must be such that it will enable the female connection member to be engaged with and connected to a predetermined end of a center sill member that is disposed substantially along a longitudinal centerline of a railway car in a substantially semi-permanent manner. A second end portion of such female connection member is formed integrally, preferably as a single piece, with such first end portion. The second end portion and the first end portion are formed axially opposite one another. Such second end portion of the female connection member includes a cavity formed therein. This cavity includes a substantially horizontally disposed bottom wall portion. A substantially vertically disposed back wall portion of such cavity is connected along a bottom edge thereof to a rear edge portion of such bottom wall portion. Such cavity further includes a pair of substantially vertically disposed and axially opposed side wall portions. Such side wall portions are connected along a bottom edge thereof to an outer respective outer edge portion of such bottom wall portion and along a rear edge thereof to a respective outer edge portion of such back wall portion. A vertically disposed plane which intersects a geometric centerline of each respective one of such pair of side wall portions being substantially parallel to each other. An inner surface of each of such bottom wall portion and such rear wall portion and such pair of side wall portions defining a predetermined size and a predetermined configuration of such cavity. This cavity is open adjacent both a top surface and a bottom surface thereof. There is an opening formed through a predetermined portion of each of such pair of side wall portions. Each such opening includes a slot-like portion that is formed adjacent a top surface of each of the side wall portions. A generally arcuate portion is formed through each side wall portion beneath at least a portion of the slot-like portion of such opening. Such female connection member further includes at least one strengthening mechanism which is formed integrally with at least one of such side wall portions of such second end portion of such female connection member. Such strengthening mechanism is disposed adjacent at least one of such slot-like portions adjacent the top surface of at least one of such pair of side wall portions. This strengthening mechanism provides the requisite amount of force absorbing capability to such female connection member during service in a train consist.

OBJECTS OF THE INVENTION

It is, therefore, one of the primary objects of the present invention to provide a female connection member for an articulated coupling apparatus which can withstand the maximum forces that will normally be encountered during operation of such articulated coupling apparatus in a train consist.

Another object of the present invention is to provide a strengthening mechanism for a female connection member of an articulated coupling apparatus that will not interfere with either the assembly or disassembly of such articulated coupling apparatus.

Still another object of the present invention is to provide a strengthening mechanism for a female connection member of an articulated coupling apparatus which can be easily formed as a single piece casting with such female connection member.

Yet another object of the present invention is to provide a strengthening mechanism for a female connection member of an articulated coupling apparatus which does not add significantly to the manufacturing cost.

An additional object of the present invention is to provide a strengthening mechanism for a female connection member of an articulated coupling apparatus which will require a minimum amount of maintenance.

In addition to the above described objects and advantages of the present invention, various other objects and advantages of such female connection member for an articulated coupling apparatus will become more readily apparent to those persons who are skilled in the railway coupling art from the following more detailed description, particularly, when such description is taken in conjunction with the attached drawing figures and with the appended claims.

BRIEF DESCRIPTION OF THE INVENTION

Figure 1:
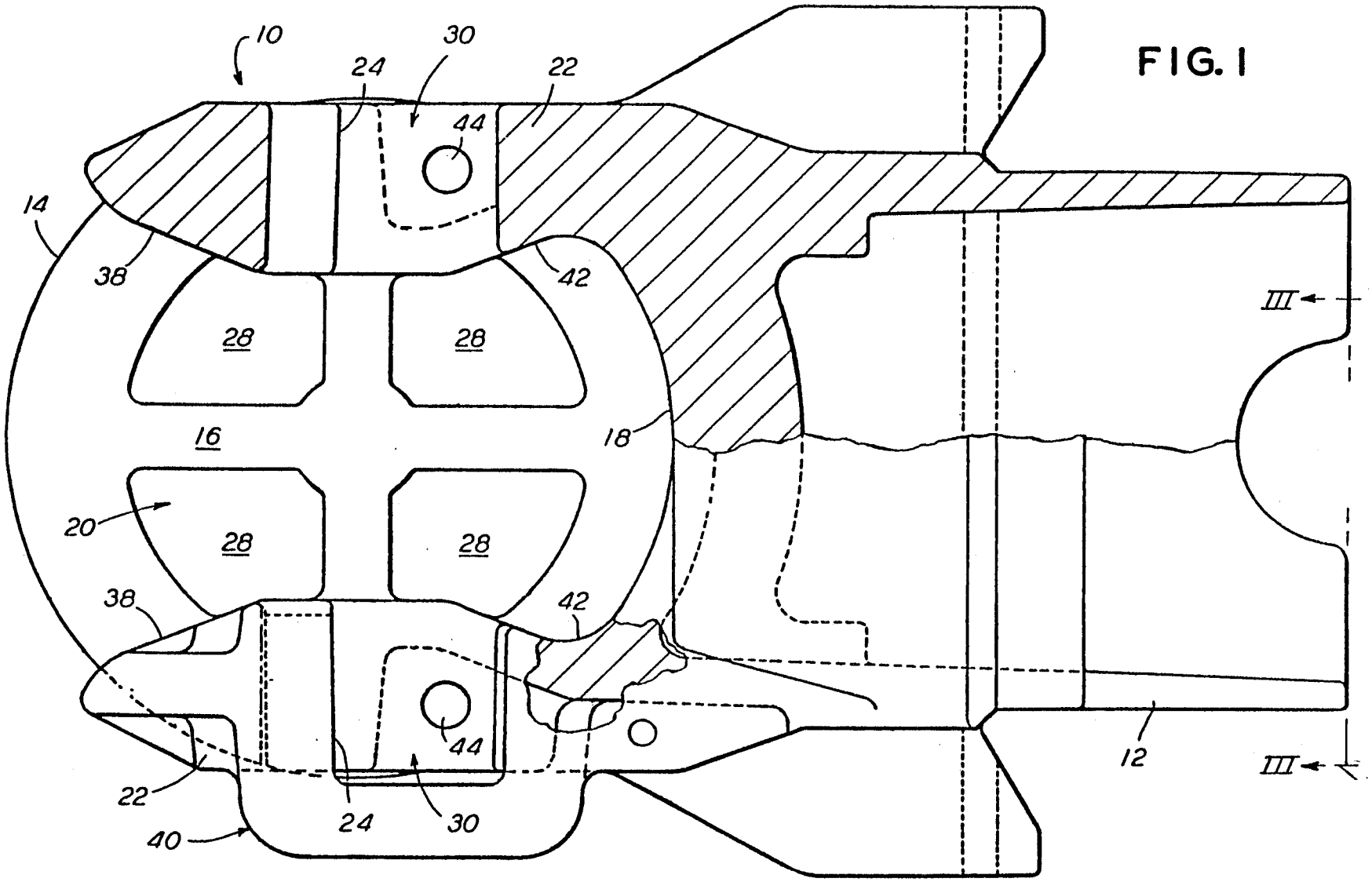
FIG. 1 is a top view which illustrates a presently preferred embodiment of a female connection member of an articulated coupling apparatus which includes a strengthening mechanism incorporated therein.

Prior to proceeding to the more detailed description of the female connection member for an articulated railway car coupling apparatus, constructed according to the present invention, it should be noted that in each of the several views illustrated in the drawings, identical components having identical functions have been identified, for the sake of clarity, with identical reference numerals.

Figure 2:
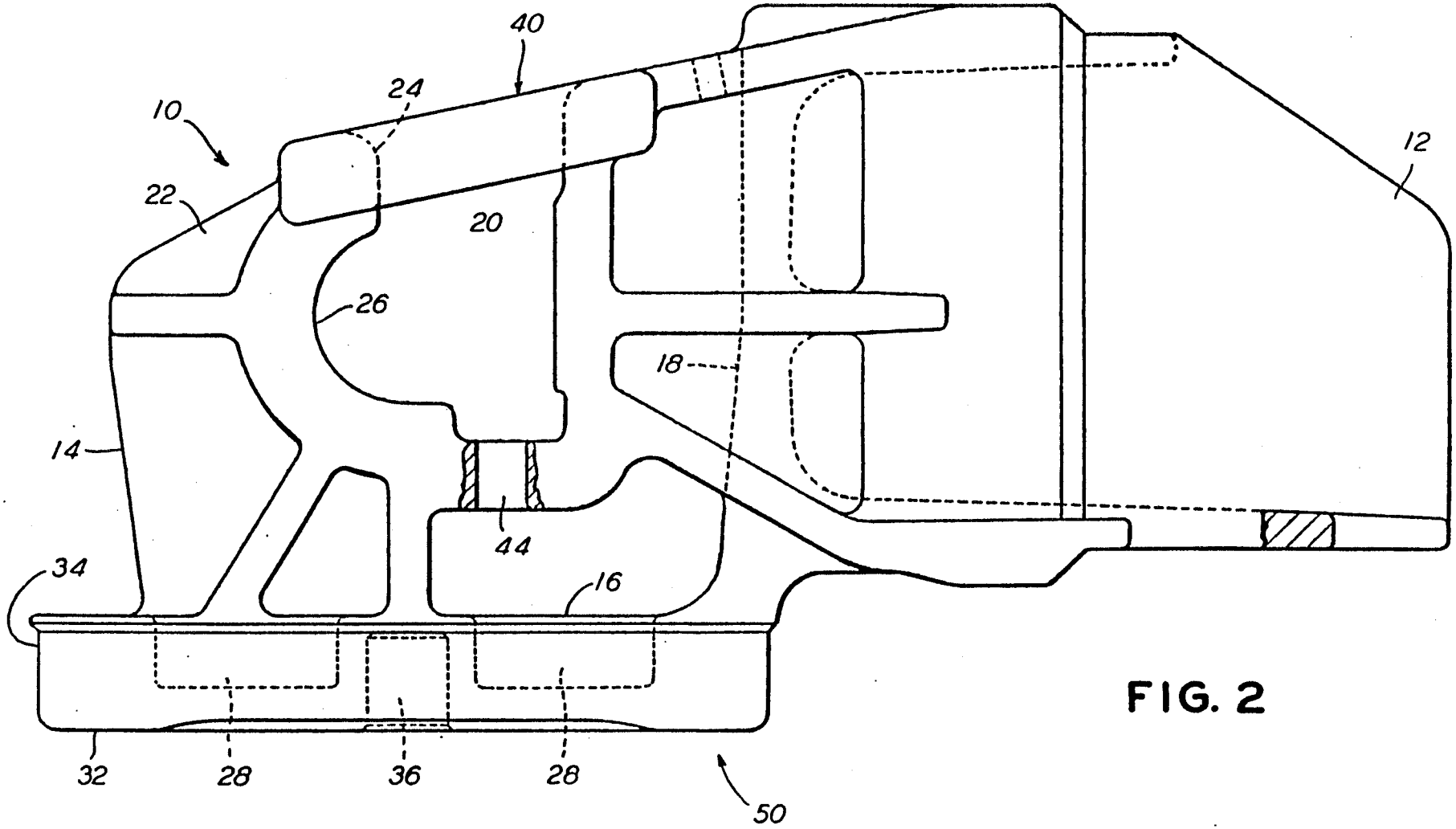
FIG. 2 is a side elevation view of the female connection member illustrated in FIG. 1.
Figure 3:
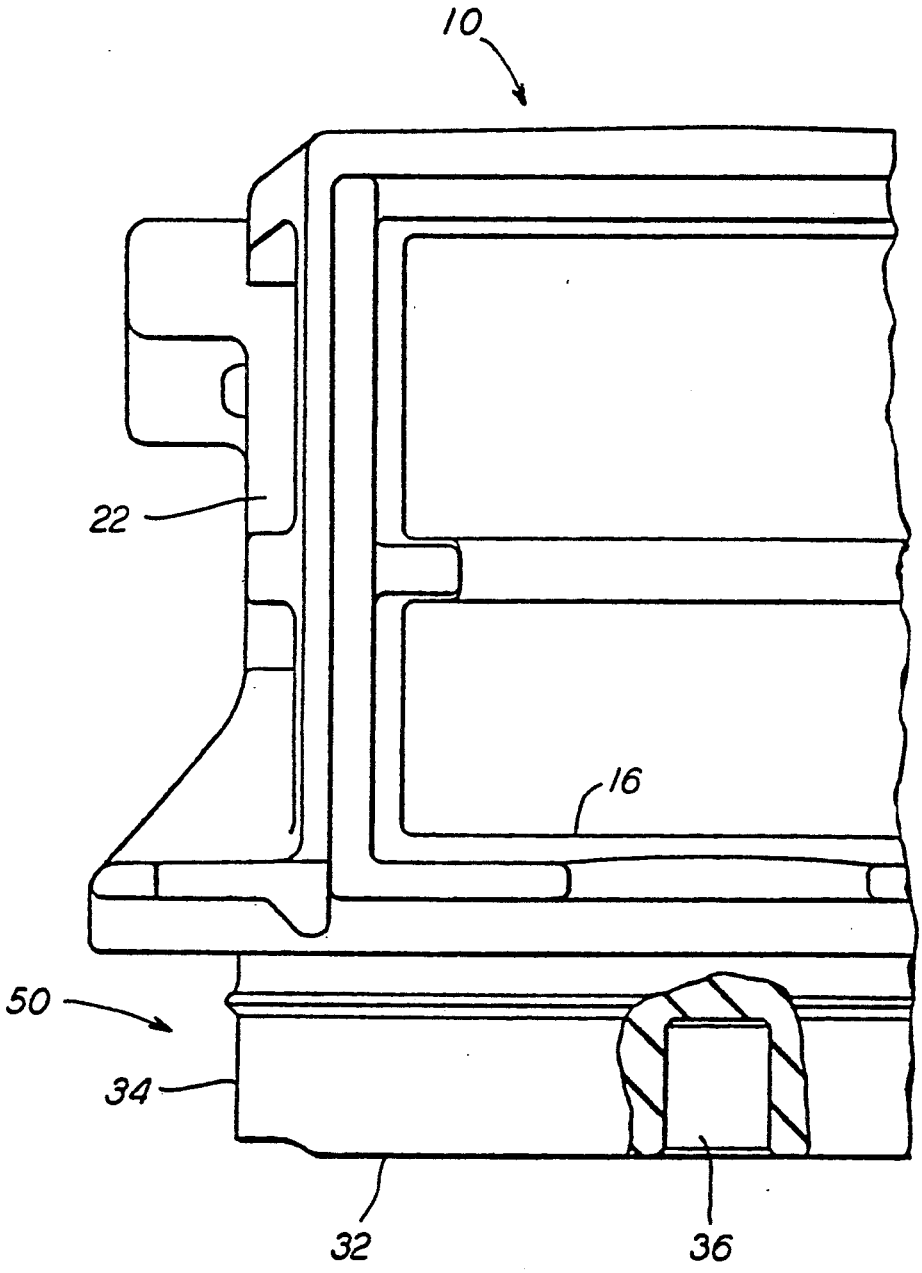
FIG. 3 is a view taken along the lines III—III of FIG. 1.

Reference is now particularly made to FIGS. 1 through 3, wherein there is illustrated one presently preferred embodiment of a female connection member, generally designated 10, for use in an articulated coupling apparatus (not shown), but disclosed in our copending patent application Ser. No. 07/520,687 now U.S. Pat. No. 5,065,679 which was filed on May 8, 1990. The disclosure of patent application Ser. No. 07/520,687 is incorporated herein by reference thereto.

This female connection member 10 includes a first end portion 12. Such first end portion 12 has a predetermined configuration which will enable the female connection member 10 to be engaged with and secured to a predetermined end (not shown) of a center sill member (not shown) of a railway car (not shown) in a semi-permanent manner. Such center sill member is disposed substantially along the longitudinal centerline of such railway car. The female connection member 10 includes a second end portion 14. Such second end portion 14 is formed integrally, preferably as a one piece casting, with the first end portion 12 of the female connection member 10. Such second end portion 14 and first end portion 12 of the female connection member 10 being disposed substantially axially opposite one another.

A cavity, generally designated 20, is formed in such second end portion 14 of the female connection member 10. This cavity 20 receives therein at least a portion of each of the second end portion (not shown) of a male connection member (not shown) and a aperture (not shown) formed through such second end portion of the male connection member. Such cavity 20 is formed by a substantially horizontally disposed bottom wall portion 16, a substantially vertically disposed back wall portion 18 which is connected along a bottom edge thereof to a rear edge portion of such bottom wall portion 16 and a pair of substantially vertically disposed and axially opposed side wall portions 22. Such pair of side wall portions 22 are connected along a bottom edge thereof to an outer respective edge portion of the bottom wall portion 16. Each of the side wall portions 22 are also connected along a rear edge thereof to a respective outer edge portion of such back wall portion 18. A vertically disposed plane which intersects a geometric centerline of each respective one of such pair of vertically disposed side wall portions 22 being substantially parallel to one another. As is evident from the drawing figures and the above description, an inner surface of each of such bottom wall portion 16, the rear wall portion 18 and the pair of side wall portions 22 define a predetermined size and a predetermined configuration of such cavity 20. It is also evident that such cavity 20 in the second end portion 14 of the female connection member 10 is open adjacent a top surface and a front surface thereof.

An opening, generally designated 30, is formed through a predetermined portion of each of such pair of side wall portions 22 to accommodate the shafts (not shown) of a bearing assembly (not shown) used to connect the male connection member of the articulated coupling apparatus to such female connection member 10. Each such opening 30 includes a slot-like portion 24 that is formed adjacent a top surface of such pair of side wall portions 22. Each of the openings 30 also includes a generally arcuate portion 26 which is formed below at least a portion of such slot-like portion 24.

Such female connection member 10 further includes at least one strengthening mechanism, generally designated 40. Such strengthening mechanism 40 is formed integrally with at least one of such pair of side wall portions 22 adjacent the second end portion 14 of such female connection member 10. The strengthening mechanism 40 is disposed adjacent the top surface of such at least one side wall portion 22 and adjacent such slot-like portion 24. This strengthening mechanism 40 is designed to provide the requisite amount of force absorbing capability required by the female connection member 10 during service in a train consist. In the presently preferred embodiment of the invention, such strengthening mechanism 10 is formed as a generally U-shaped member to facilitate assembly of the articulated coupling apparatus. In addition, such generally U-shaped strengthening mechanism 40 will be generally rectangular in cross-section in the presently preferred embodiment.

In order to reduce the weight requirements of such female connection member 10, in a presently preferred embodiment, the bottom wall portion 16 of such cavity 20 is provided with a plurality of cavities 28 formed adjacent an upper surface of such bottom wall portion 16. As illustrated in FIG. 1 such cavities are generally pie-shaped. However, other shapes are within the scope of the present invention. Such bottom wall portion 16 of the cavity 20 formed in such second end portion 14 of the female connection member 10 further includes a center plate-like member, generally designated 50, which is configured to matingly and rotatably engage a center bowl (not shown) of a bolster bowl portion (not shown) of a railway car truck (not shown). The bottom surface 32 of such center plate-like number 50, is a wear surface which is hardened to at least about 300 Brinell for a depth of at least about 0.125 inch. Preferably such bottom wear surface 32 will have a Brinell hardness of about 375 because it is a bearing surface subjected to considerable weight during service. Such center plate-like member 50 includes a vertically disposed wear surface 34 which has a Brinell hardness of at least about 300 for a distance of at least about 1.0 inch up from such bottom wear surface 32 and for a depth of at least about 0.125 inch. Preferably such vertical wear surface 34 will be hardened to a Brinell hardness of about 375 over the entire surface area. Additionally, such center plate-like member 50, which is substantially round, includes a vertically disposed cavity 36 formed therein which is disposed substantially at a center thereof. Such cavity 36 is adjacent such bottom wear surface 32. The cavity 36 is provided to facilitate assembly of such female connection member 10 with such railway car truck.

As best seen in FIGS. 1 and 2, the vertically disposed back wall portion 18 of such cavity 20 formed in such second end portion 14 of the female connection member 10 has a predetermined configuration. Such predetermined configuration of such back wall portion 18 is a substantially concave shape in at least one of a vertical plane and a horizontal plane. Preferably such back wall portion 18 will have such concave shape in both such horizontal plane and such vertical plane.

FIG. 1 further illustrates that each of such pair of side wall portions 22 of such cavity 20 includes a vertically disposed tapered portion 38 adjacent the front surface of such cavity 20 and a vertically disposed tapered portion 42 adjacent such back wall portion 18 of such cavity 20. Such tapered portions 38 and 42 enables a second end of such male connection member to rotate a predetermined distance about a spherical member (not shown) in a horizontal direction.

The female connection member 10 also includes a means 44 for engaging a locking mechanism (not shown) which couples such male connection member to such female connection member 10. As best seen in FIGS. 1 and 2, the means 44 is an aperture formed in at least one of such pair of side wall portions 22 adjacent such opening 30.

Further, illustrated in each of FIGS. 1 through 3, the presently preferred embodiment includes a plurality of rib members 46 formed on an outer surface of each of such pair of side wall portions 22 which provide a requisite amount of strength to such female connection member 10.

While a number of presently preferred embodiments of the present invention have been described in detail above, it should be understood that persons skilled in the railway coupling art can make various modifications and adaptations to such female connection member without departing from the spirit and scope of the appended claims.

We claim:

1. A female connection member having a strengthening mechanism for use in an articulated type coupling arrangement which can be easily retrofitted to existing railway cars and is capable of connecting together, in a substantially semi-permanent manner, at least one predetermined end of a first railway car and an adjacent predetermined end of a second railway car, said female connection member comprising:

a. a first end portion having a predetermined configuration which will enable said female connection member to be engaged with and connected to a predetermined end of a center sill member disposed substantially along a longitudinal centerline of a railway car to be connected in such semi-permanent manner;

b. a second end portion formed integrally with said first end portion and disposed axially opposite thereof;

c. a cavity formed in said second end portion of said female connection member, said cavity including:

(i) a substantially horizontally disposed bottom wall portion, (ii) a substantially vertically disposed back wall portion connected along a bottom edge thereof to a rear edge portion of said bottom wall portion, and (iii) a pair of substantially vertically disposed and axially opposed side wall portions connected along a bottom edge thereof to an outer respective edge of said bottom wall portion and along a rear edge thereof to a respective outer edge of said back wall portion, each side wall portion having a vertically disposed plane which intersects a geometric centerline of each respective side wall portion and being substantially parallel to each other, an inner surface of each of said bottom wall portion and said rear wall portion and said pair of side wall portions define a predetermined size and a predetermined shape of said cavity which is open adjacent a top surface and a front surface thereof;

d. an opening formed through a predetermined portion of each of said pair of side wall portions for receiving a shaft portion of a bearing assembly for connecting such cars, each said opening includes:

(i) a slot-like portion formed adjacent a top surface of each of said pair of side wall portions, and (ii) a generally arcuate portion formed below at least a portion of said slot-like portion; and e. at least one strengthening mechanism formed integrally with at least one of said pair of side wall portions adjacent said second end portion of said female connection member and disposed adjacent said slot-like portion adjacent said top surface of at least one of said pair of side wall portions to provide a requisite amount of force absorbing capability to said female connection member in response to forces exerted by such shaft portion during service in a train consist.

2. An articulated coupler female connection member, according to claim 1, wherein said at least one strengthening mechanism is formed as a generally U-shaped member.

3. An articulated coupler female connection member, according to claim 2, wherein said generally U-shaped strengthening mechanism is generally rectangular in cross-section.

4. An articulated coupler female connection member, according to claim 3, wherein said female connection member further includes:

a. a center plate-like member which matingly and rotatably engages a center bowl portion of a bolster portion of a railway car truck formed on a bottom surface of said bottom wall portion of said cavity disposed on said second end portion of said female connection member, said center plate-like member being substantially round and a bottom wear surface thereof is a bearing surface which is hardened to a Brinell hardness of at least about 300 for a depth of at least about 0.125 inch, a vertically disposed side wall of said center plate-like member is hardened to a Brinell hardness of at least about 300 for a distance of at least about 1.0 inch up from said bottom wear surface and to a depth of at least about 0.125 inch; and b. a vertically disposed cavity formed substantially at a center of said center plate-like member adjacent said bottom wear surface to facilitate assembly of said female connection member with a railway car truck.

5. An articulated coupler female connection member, according to claim 4, wherein said Brinell hardness of said bearing surface is at least about 375.

6. An articulated coupler female connection member, according to claim 5, wherein said Brinell hardness of said side wall of said center plate-like member is at least about 375.

7. An articulated coupler female connection member, according to claim 6, wherein said side wall of said center plate-like member is hardened to said depth of at least about 0.125 inch and to said Brinell hardness of at least about 375 over a substantially entire surface thereof.

8. An articulated coupler female connection member, according to claim 6, wherein said predetermined configuration of said vertically disposed back wall portion of said cavity is a substantially concave shape in each of said vertical plane and said horizontal plane.

9. An articulated coupler female connection member, according to claim 8, wherein each of said pair of substantially vertically disposed side wall portions of said cavity includes a vertically disposed tapered portion adjacent said front surface of said cavity and adjacent said vertically disposed back wall portion of said cavity to enable a second end of a male connection member to rotate a predetermined distance about a spherical member in a horizontal direction.

10. An articulated coupler female connection member, according to claim 9, wherein said bottom wall portion of said cavity formed in said second end of said female connection member includes a plurality of cavities formed adjacent an upper surface thereof to provide a reduction in weight of said female connection member.

11. An articulated coupler female connection member, according to claim 10, wherein said female connection member further includes at least one aperture formed in at least one of said pair of side wall portions adjacent said opening.

12. An articulated coupler female connection member, according to claim 11, wherein each of said pair of side wall portions includes a plurality of rib members formed on an outer surface thereof to provide a requisite amount of strength in said female connection member.

13. An articulated coupler female connection member, according to claim 1, wherein said bottom wall portion of said cavity formed in said second end portion of said female connection member further includes a center plate-like member which matingly and rotatably engages a center bowl of a bolster bowl portion of a railway car truck.

14.. An articulated coupler female connection member, according to claim 13, wherein a bottom wear surface of said center plate-like member is hardened to a Brinell hardness of at least about 300.

15. An articulated coupler female connection member, according to claim 4, wherein said bottom wear surface of said center plate-like member is hardened to a depth of at least about 0.125 inch.

16. An articulated coupler female connection member, according to claim 15, wherein a vertical wear surface of said center plate-like member is hardened to a Brinell hardness of at least about 300 for a distance of at least about 1.0 inch from said bottom wear surface.

17. An articulated coupler female connection member, according to claim 16, wherein said vertical wear surface of said center plate-like member is hardened to a depth of at least about 0.125 inch for said distance of at least about 1.0 inch from said bottom wear surface.

18. An articulated coupler female connection member, according to claim 13, wherein said center plate-like member further includes a vertically disposed cavity formed substantially at a center thereof and adjacent a bottom wear surface thereof to facilitate assembly of said female connection member with a railway car truck.

19. An articulated coupler female connection member, according to claim 1, wherein said vertically disposed back wall portion of said cavity formed in said second end portion of said female connection member has a predetermined configuration.

20. An articulated coupler female connection member, according to claim 19, wherein said predetermined configuration of said vertically disposed back wall portion of said cavity is a substantially concave shape in at least one of a vertical plane and a horizontal plane.

21. An articulated coupler female connection member, according to claim 20, wherein said predetermined configuration of said vertically disposed back wall portion of said cavity is a substantially concave shape in each of said vertical plane and said horizontal plane.

22. An articulated coupler female connection member, according to claim 1, wherein each of said pair of substantially vertically disposed side wall portions of said cavity includes a vertically disposed tapered portion adjacent said front surface of said cavity and adjacent said vertically disposed back wall portion of said cavity to enable a second end of a male connection member to rotate a predetermined distance about a spherical member in a horizontal direction.

23. An articulated coupler female connection member, according to claim 1, wherein said bottom wall portion of said cavity formed in said second end of said female connection member includes a plurality of cavities formed adjacent an upper surface thereof to provide a reduction in weight of said female connection member.

24. An articulated coupler female connection member, according to claim 1, wherein said female connection member further includes a means for engaging a locking mechanism which couples a male connection member to said female connection member.

25. An articulated coupler female connection member, according to claim 24, wherein said means for engaging such locking mechanism is an aperture formed in at least one of said pair of side wall portions adjacent said opening.

26. An articulated coupler female connection member, according to claim 1, wherein each of said pair of side wall portions includes a plurality of rib members formed on an outer surface thereof to provide a requisite amount of strength in said female connection member.

* * * * *